US011447844B2

(12) United States Patent
Pipard et al.

(10) Patent No.: US 11,447,844 B2
(45) Date of Patent: Sep. 20, 2022

(54) MANUFACTURING METHOD FOR HOT ROLLED STEEL SHEET

(71) Applicant: ArcelorMittal, Luxembourg (LU)

(72) Inventors: Jean Marc Pipard, Vaux (FR); Astrid Perlade, Le Ban-Saint-Martin (FR); Bastien Weber, Metz (FR); Florence Pechenot, Metz (FR); Aurelie Milani, Volmerange-les-mines (FR)

(73) Assignee: ArcelorMittal, Luxembourg (LU)

( * ) Notice: Subject to any disclaimer, the term of this patent is extended or adjusted under 35 U.S.C. 154(b) by 143 days.

(21) Appl. No.: 17/087,916

(22) Filed: Nov. 3, 2020

(65) Prior Publication Data

US 2021/0130921 A1 May 6, 2021

Related U.S. Application Data

(62) Division of application No. 15/325,690, filed as application No. PCT/IB2015/001159 on Jul. 10, 2015, now Pat. No. 10,858,716.

(30) Foreign Application Priority Data

Jul. 11, 2014 (WO) ..... PCT/IB2014/001312

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/005* (2013.01); *C21D 8/0205* (2013.01);
(Continued)

(58) Field of Classification Search
CPC ..... C21D 9/46; C21D 6/005; C21D 8/0205; C21D 8/0226; C21D 8/0263;
(Continued)

(56) References Cited

U.S. PATENT DOCUMENTS 4,571,367 A 2/1986 Yamada
6,364,968 B1 * 4/2002 Yasuhara ..... C21D 1/20 148/333
(Continued)

FOREIGN PATENT DOCUMENTS

CA 2832159 A1 10/2012
CA 2837052 A1 11/2012
(Continued)

OTHER PUBLICATIONS

Zajac et al.:"Characterization and Quantification of Complex Bainitic Complex Microstructures in High and Ultra-High Strength Steels"—Materials Science Forum, vol. 500-501, pp. 387-394; Nov. 2005.
Zhang Guoqiang, Study on fatigue properties of heavy duty carburized gear steel 1.6.2.3 on p. 17, and table 1.6 on p. 18 1-20, Engineering Science and Technology I, No. 2, Feb. 15, 2012, see English translation.

*Primary Examiner* — John A Hevey
(74) *Attorney, Agent, or Firm* — Davidson, Davidson & Kappel, LLC

(57) ABSTRACT

A method for the fabrication of a hot rolled steel includes providing a liquid metal comprising a certain chemical composition; carrying out a vacuum or SiCa treatment, the chemical composition including, expressed by weight $0.0005\% \leq Ca \leq 0.005\%$, if a SiCA treatment is carried out; dissolving quantities of Ti and N in the liquid metal so as to satisfy $(\%\ [Ti]) \times (\%\ [N]) < 6.10^{-4}\%^2$; casting the steel to obtain a cast semi-finished product; rolling the cast semi-finished product with an end-of-rolling temperature between 880° C. and 930° C., a reduction rate of the penultimate pass being less than 0.25, and a start-of-rolling temperature of the penultimate pass being less than 960° C. to obtain a hot-rolled product, then cooling the hot rolled product at a rate between 20 and 150° C./s to obtain a hot rolled steel sheet; and coiling the hot rolled product to obtain a hot rolled steel sheet.

12 Claims, 5 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/12*** | (2006.01) |
| ***C21D 6/00*** | (2006.01) |
| ***C22C 38/22*** | (2006.01) |
| ***C22C 38/26*** | (2006.01) |
| ***C22C 38/28*** | (2006.01) |
| ***C23C 2/06*** | (2006.01) |
| ***C23C 2/40*** | (2006.01) |
| ***C21D 8/04*** | (2006.01) |

(52) U.S. Cl.

CPC ..... *C21D 8/0226* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/26* (2013.01); *C22C 38/28* (2013.01); *C23C 2/06* (2013.01); *C23C 2/40* (2013.01); *C21D 8/04* (2013.01); *C21D 2211/002* (2013.01); *C21D 2211/004* (2013.01); *C21D 2211/005* (2013.01)

(58) Field of Classification Search

CPC .. C21D 8/0278; C21D 8/04; C21D 2211/002; C21D 2211/004; C21D 2211/005; C22C 38/001; C22C 38/002; C22C 38/02; C22C 38/04; C22C 38/06; C22C 38/12; C22C 38/14; C22C 38/22; C22C 38/26; C22C 38/28; C22C 33/04; C22C 38/18; C22C 38/38; C23C 2/06; C23C 3/40; B21C 37/02

See application file for complete search history.

(56) References Cited

U.S. PATENT DOCUMENTS

| | | | | |
|---|---|---|---|---|
| 7,501,030 | B2 | 3/2009 | Nakata et al. | |
| 9,540,719 | B2 * | 1/2017 | Perlade | C21D 6/005 |
| 10,590,506 | B2 * | 3/2020 | Yokoi | C22C 38/30 |
| 2002/0162613 | A1 | 11/2002 | Kashima et al. | |
| 2008/0283158 | A1 * | 11/2008 | Nagao | C21D 8/02 148/547 |
| 2010/0022157 | A1 | 9/2010 | Drillet et al. | |
| 2010/0221573 | A1 * | 9/2010 | Drillet | C22C 38/38 428/653 |
| 2012/0031528 | A1 | 2/2012 | Hayashi et al. | |
| 2013/0061989 | A1 | 3/2013 | Nakamura et al. | |
| 2014/0110022 | A1 | 4/2014 | Sano | |
| 2014/0230970 | A1 | 8/2014 | Perlade et al. | |
| 2015/0203932 | A1 | 7/2015 | Drillet et al. | |
| 2015/0368741 | A1 * | 12/2015 | Nakajima | C22C 38/28 148/333 |

FOREIGN PATENT DOCUMENTS

| | | | |
|---|---|---|---|
| CA | 2879069 | A1 | 2/2014 |
| CN | 101285156 | A | 10/2008 |
| EP | 1462535 | A1 | 9/2004 |
| EP | 2020451 | A1 | 2/2009 |
| EP | 2735622 | A1 | 5/2014 |
| JP | 2001200331 | A | 7/2001 |
| JP | 2004218077 | A | 8/2004 |
| JP | 2004307919 | A | 11/2004 |
| JP | 2012012701 | A | 1/2012 |
| JP | 2013014844 | A | 1/2013 |
| JP | 2014109056 | A | 6/2014 |
| KR | 1020130135972 | A | 12/2013 |
| RU | 2414515 | C1 | 3/2011 |
| WO | 2010137317 | A1 | 12/2010 |
| WO | 2012127125 | A1 | 9/2012 |
| WO | 2013011791 | A1 | 1/2013 |

* cited by examiner

MANUFACTURING METHOD FOR HOT ROLLED STEEL SHEET

This is a Divisional of U.S. Pat. No. 15,325,690, filed Jan. 11, 2017, which is a National Phase Application of PCT/IB2015/001159, filed on Sep. 10, 2015, which claims priority to PCT/IB2014/001312, filed on Jul. 11, 2014, all of which are hereby incorporated by reference herein.

This invention relates to a hot rolled steel sheet.

This invention further relates to a method that makes it possible to fabricate a steel sheet of this type.

BACKGROUND

The need to make automotive vehicles lighter in weight and to increase safety has led to the creation of high-strength steels.

Historically, development began with steels including additive elements, mainly to obtain precipitation hardening.

Later, "dual phase" steels were proposed that include martensite in a ferrite matrix to obtain structural hardening.

To obtain higher strength levels combined with workability, "TRIP" (Transformation Induced Plasticity) steels were developed, the microstructure of which consists of a ferrite matrix including bainite and residual austenite which is transformed into martensite under the effect of the deformation, for example during a stamping operation.

To achieve a mechanical strength greater than 800 MPa, multiphase steels with a majority bainite structure have been proposed. These steels are used in industry, and in particular in the automobile industry, to construct structural parts.

This type of steel is described in publication EP 2020451. To obtain an elongation at failure greater than 10% as well as mechanical strength greater than 800 MPa, the steels described in this publication include, in addition to the known presence of carbon, manganese and silicon, molybdenum and vanadium. The microstructure of the steels includes essentially upper bainite (at least 80%) as well as lower bainite, martensite and residual austenite.

However, the fabrication of these steels is expensive on account of the presence of molybdenum and vanadium.

Moreover, certain automobile parts such as bumper beams and suspension arms are fabricated by forming operations that combine different modes of deformation. Certain microstructural characteristics of the steel may be well suited for one mode of deformation but less well suited for another mode. Certain portions of the parts must have a high elongation yield-strength; others must have good suitability for the forming of a cut edge. This latter property is assessed using the hole-expansion method described in the ISO standard 16630:2009.

BRIEF SUMMARY

One type of steel that remedies these disadvantages contains no molybdenum or vanadium and includes titanium and niobium in specific amounts, these latter two elements conferring the sheet, among other things, the intended strength, necessary hardening and the intended hole-expansion ratio.

The steel sheets that are the subject of this invention are subjected to hot coiling because this operation makes it possible, among other things, to precipitate the titanium carbides and to confer maximum hardness to the sheet.

However, it has been found that for certain steels that include elements that are more oxidizable than iron, such as silicon, manganese, chromium and aluminum, certain sheets, once coiled at high temperature, exhibit surface defects. These defects can be amplified by a subsequent deformation of the sheets. To prevent these defects, it is therefore necessary either to perform a rapid cooling of the coils by means of an additional process which entails a higher cost, or to perform the coiling operation at a lower temperature, which causes a reduction in the precipitation of titanium.

An object of the invention provides a sheet for which the high temperature coiling operation does not generate the formation of the above mentioned surface defects.

An additional object of the invention provides a steel sheet in the uncoated or galvanized state. The composition and mechanical characteristics of the steel must be compatible with the constraints and thermal cycles of the continuous hot dip zinc coating processes.

An additional object of the invention provides a method for the fabrication of a steel sheet that does not require high rolling forces, which makes it possible to perform fabrication over a wide range of thicknesses, for example between 1.5 and 4.5 mm.

Finally, an additional object of the invention provides a hot rolled steel sheet, the fabrication cost of which is economical, that simultaneously exhibits a yield stress greater than 680 MPa at least in the direction transverse to the rolling direction, and less than or equal to 840 MPa, mechanical strength between 780 MPa and 950 MPa, elongation at failure greater than 10% and a hole-expansion ratio (Ac) greater than or equal to 45%.

The present invention provides a sheet including, expressed in percent by weight:

$0.04\% \leq C \leq 0.08\%$
$1.2\% \leq Mn \leq 1.9\%$
$0.1\% \leq Si \leq 0.3\%$
$0.07\% \leq Ti \leq 0.125\%$
$0.05\% \leq Mo \leq 0.35\%$
$0.15\% < Cr \leq 0.6\%$ when $0.05\% \leq Mo \leq 0.11\%$, or
$0.10\% \leq Cr \leq 0.6\%$ when $0.11\% < Mo \leq 0.35\%$
$Nb \leq 0.045\%$
$0.005\% \leq Al \leq 0.1\%$
$0.002\% \leq N \leq 0.01\%$
$S \leq 0.004\%$
$P < 0.020\%$
and optionally $0.001\% \leq V \leq 0.2\%$, the remainder consisting of iron and unavoidable impurities resulting from processing, the microstructure of which is constituted by granular bainite, the area percentage of which is greater than 70%, and ferrite, the area percentage of which is less than 20%, with the remainder, if any, consisting of lower bainite, martensite and residual austenite, the sum of the martensite and residual austenite contents being less than 5%.

The sheet according to the invention can also include the following optional characteristics, considered individually or in any technically possible combinations:

the chemical composition consists of, expressed in percent by weight:

$0.04\% \leq C \leq 0.08\%$
$1.2\% \leq Mn \leq 1.9\%$
$0.1\% \leq Si \leq 0.3\%$
$0.07\% \leq Ti \leq 0.125\%$
$0.05\% \leq Mo \leq 0.25\%$
$0.16\% \leq Cr \leq 0.55\%$ when $0.05\% \leq Mo \leq 0.11\%$, or
$0.10\% \leq Cr \leq 0.55\%$ when $0.11\% < Mo \leq 0.25\%$
$Nb \leq 0.045\%$
$0.005\% \leq Al \leq 0.1\%$
$0.002\% \leq N \leq 0.01\%$
$S \leq 0.004\%$
$P < 0.020\%$ the remainder consisting of iron and unavoidable impurities resulting from processing, the composition of the steel includes, expressed in percent by weight:

0.27%≤Cr≤0.52% when 0.05%≤Mo≤0.11%, or 0.10%≤Cr≤0.52% when 0.11%<Mo≤0.25% the composition of the steel includes, expressed in percent by weight:

0.05%≤Mo≤0.18%, and 0.16%≤Cr≤0.55% when 0.05%≤Mo≤0.11%, or 0.10%≤Cr≤0.55% when 0.11%<Mo≤0.18% the chemical composition includes, expressed in percent by weight:

0.05%≤C≤0.07%

1.4%≤Mn≤1.6%

0.15%≤Si≤0.3%

Nb≤0.04%

0.01%≤Al≤0.07% the chemical composition includes, expressed in percent by weight:

$0.040\% \leq Ti_{eff} \leq 0.095\%$ where $Ti_{eff} = Ti - 3.42 \times N$, where Ti is the titanium content expressed by weight and N is the nitrogen content expressed by weight the steel sheet is coiled and pickled, the coiling operation being performed at a temperature between 525° C. and 635° C. followed by a pickling operation, and the depth of the surface defects due to oxidation distributed over n oxidation zones i of the coiled sheet, where i is between 1 and n, and the n oxidation zones extent over an observed length $l_{ref}$, satisfies:

a first maximum depth criterion defined by $$P_i^{max} \leq 8 \text{ micrometers}$$

with $P_i^{max}$: maximum depth of a defect due to oxidation in the oxidation zone i of this coiled sheet, and a second average depth criterion defined by $$\frac{1}{l_{ref}} \sum_{i}^{n} P_i^{avg} \times l_i \leq 2.5 \text{ micrometers},$$

where $P_i$ average depth of defects due to oxidation in an oxidation zone i, and $l_i$: length of the oxidation zone i the observed length $l_{ref}$ of the defects due to oxidation is greater than or equal to 100 micrometers.

the observed length $l_{ref}$ of the defects due to oxidation is greater than or equal to 500 micrometers.

the sheet is coiled into adjacent turns at a minimum coiling tension of 3 metric tons-force.

The invention further provides a method for the fabrication of a hot rolled steel sheet with a yield stress at least greater than 680 MPa in the direction transverse to the rolling direction, and less than or equal to 840 MPa, having a strength between 780 MPa and 950 MPa and elongation at failure greater than 10%, characterized in that a steel is obtained in the form of liquid metal consisting of the following elements, expressed in percent by weight:

0.04%≤C≤0.08%

1.2%≤Mn≤1.9%

0.1%≤Si≤0.3%

0.07%≤Ti≤0.125%

0.05%≤Mo≤0.35%

0.15%<Cr≤0.6% when 0.05%≤Mo≤0.11%, or 0.10%≤Cr≤0.6% when 0.11%<Mo≤0.35%

Nb≤0.045%

0.005%≤Al≤0.1%

0.002%≤N≤0.01%

S≤0.004%

P<0.020% and optionally 0.001% V 0.2% the remainder constituted by iron and unavoidable impurities, and that a vacuum or SiCa treatment is carried out, whereby in the latter case the composition further includes, with the elements expressed in percent by weight: 0.0005%≤Ca≤0.005%, the quantities of titanium [Ti] and nitrogen [N] dissolved in the liquid metal satisfying $(\%\,[Ti]) \times (\%\,[N]) < 6.10^{-4}\%^2$, the steel being cast to obtain a cast semi-finished product, this semi-finished product being optionally reheated to a temperature between 1160° C. and 1300° C., then, this cast semi-finished product being rolled with an end-of-rolling temperature between 880° C. and 930° C., the reduction rate of the penultimate pass being less than 0.25, the reduction rate of the final pass being less than 0.15, the sum of these two rates of reduction being less than 0.37 and the start-of-rolling temperature of the penultimate pass being less than 960° C. to obtain a hot-rolled product, then this hot rolled product is cooled at a rate between 20 and 150° C. to obtain a hot rolled steel sheet.

The method according to the invention can also include the following optional characteristics considered individually or in any technically possible combinations:

the hot-rolled steel sheet is coiled at a temperature between 525 and 635° C.

the composition consists of the following elements, expressed in percent by weight:

0.04%≤C≤0.08%

1.2%≤Mn≤1.9%

0.1%≤Si≤0.3%

0.07%≤Ti≤0.125%

0.05%≤Mo≤0.25%

0.16%≤Cr≤0.55% when 0.05%≤Mo≤0.11%, or 0.10%≤Cr≤0.55% when 0.11%<Mo≤0.25%

Nb≤0.045%

0.005%≤Al≤0.1%

0.002%≤N≤0.01%

S≤0.004%

P<0.020% the remainder consisting of iron and unavoidable impurities the cooling rate of the hot-rolled product is between 50 and 150° C./s.

the composition of the steel includes, the elements being expressed by weight:

0.27%≤Cr≤0.52% when 0.05%≤Mo≤0.11%, or 0.10%≤Cr≤0.52% when 0.11%<Mo≤0.25% the composition of the steel includes, the elements being expressed by weight:

0.05%≤Mo≤0.18%, and 0.16%≤Cr≤0.55% when 0.05%≤Mo≤0.11%, or 0.10%≤Cr≤0.55% when 0.11%<Mo≤0.18% the composition of the steel includes, the elements being expressed by weight:

0.05%≤C≤0.08%

1.4%≤Mn≤1.6%

0.15%≤Si≤0.3%

Nb≤0.04%

0.01%≤Al≤0.07% the sheet is coiled at a temperature between 580 and strictly 630 C.

the sheet is coiled at a temperature between 530 and 600° C., the sheet is pickled, then the pickled sheet is reheated to a temperature between 600 and 750° C., then the reheated pickled sheet is cooled at a rate between 5 and 20° C./s, and the sheet obtained is coated with zinc in an appropriate zinc bath, the sheet is coiled in adjacent turns at a minimum coiling tension of 3 metric tons-force.

BRIEF DESCRIPTION OF THE DRAWINGS

Other characteristics and advantages of the invention will clearly emerge from the description below by way of non-limiting examples with reference to the accompanying figures in which.

DETAILED DESCRIPTION

Figure 1:
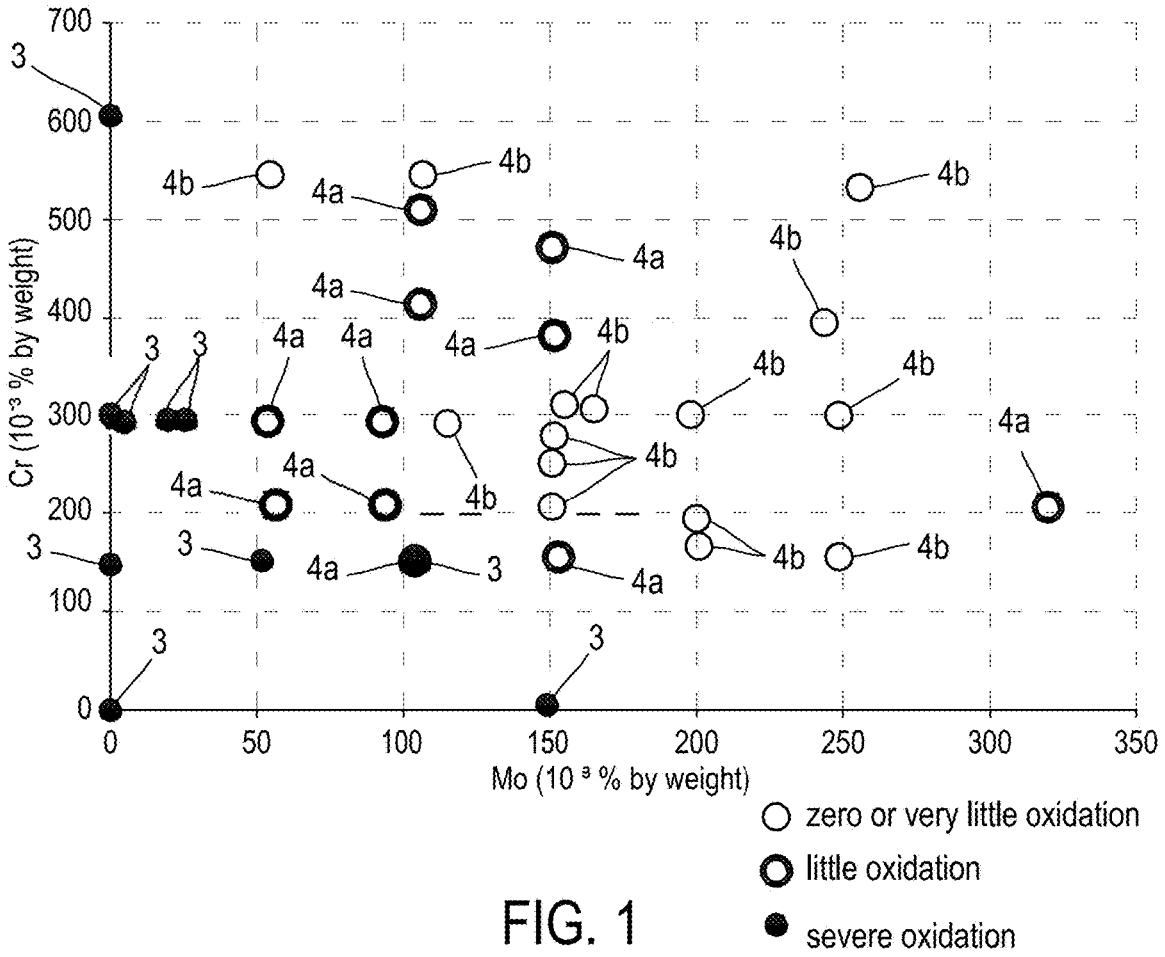
FIG. 1 is a graph illustrating the results in terms of oxidation in the coil core of sheets according to the invention and sheets of the prior art coiled at a temperature of 590° C., having different levels of chromium and molybdenum.

The inventors have discovered that the surface defects present on certain sheets coiled at high temperatures, in particular above a temperature of 570° C., are mainly located at the level of the core of the coil. In this region, the turns are in contact with each other and the oxygen partial pressure is such that only the elements that are more oxidizable than iron, such as for example silicon, manganese, and chromium, can still oxidize in contact with oxygen atoms.

The iron-oxygen phase diagram at 1 atmosphere shows that the iron oxide wustite formed at high temperatures is no longer stable beyond 570° C. and decomposes at thermodynamic equilibrium into two other phases: hematite and magnetite, one of the products of this reaction being oxygen.

The inventors have therefore determined that the conditions are met so that in the coil core, the oxygen thus released is combined with elements that are more oxidizable than iron, i.e. in particular manganese, silicon, chromium and aluminum present on the surface of the sheet. The grain boundaries of the final microstructure naturally constitute diffusion short-circuits for these elements compared to a uniform diffusion in the matrix. The result is more marked oxidation and deeper oxidation at the level of the grain boundaries.

During the pickling operation, to eliminate the layer of scale, the oxides thus formed are also removed, leaving room for defects (discontinuities) essentially perpendicular to the skin of the sheet of approximately 3 to 5 μm.

Although these defects do not cause any particular degradation of the fatigue performance for a sheet that is not subjected to deformation, that is not the case when the sheet is deformed and more particularly in the zone located in the lower or inner surface of a deformation fold where the depth of the defect can reach 25 μm.

For a coiling temperature of approximately 590° C., these surface defects are naturally present in the coil core where the surface of the sheet remains subjected to high temperatures, in particular greater than 570° C., for the longest time.

The inventors have therefore found a composition of the sheet that makes it possible to avoid the formation of intergranular oxidation in the coil core at the level of the grains of the final microstructure after pickling, the intergranular oxidation occurring at the grain boundaries of the final microstructure.

For this purpose, it has been determined that the composition of the sheet must include chromium and molybdenum defined in particular levels. Surprisingly, the inventors have shown that sheets of this type do not exhibit the above-mentioned surface defects.

According to the invention, the content by weight of carbon in the sheet is between 0.040% and 0.08%. This range of carbon content makes it possible to simultaneously obtain a high elongation at failure and a mechanical strength Rm greater than 780 MPa.

In addition, the maximum content of carbon by weight is set at 0.08%, which makes it possible to obtain a hole-expansion ratio Ac % greater than or equal to 45%.

Preferably, the content of carbon by weight is between 0.05% and 0.07%.

According to the invention, the content by weight of manganese is between 1.2% and 1.9%. When present in this quantity, manganese contributes to the strength of the sheet and limits the formation of a central segregation band. It contributes to obtaining a hole-expansion ratio Ac % greater than or equal to 45%. Preferably, the manganese content by weight is between 1.4% and 1.6%.

An aluminum content between 0.005% and 0.1% makes it possible to ensure the deoxidation of the steel during its fabrication. Preferably, the aluminum content is between 0.01% and 0.07%.

Titanium is present in the steel sheet according to the invention in a quantity between 0.07% and 0.125% by weight.

Vanadium can optionally be added in a quantity between 0.001% and 0.2% by weight. An increase in the mechanical strength up to 250 MPa can be obtained by refining the microstructure and a hardening precipitation of the carbonitrides.

In addition, the invention teaches that the nitrogen content by weight is between 0.002% and 0.01%. Although the nitrogen content can be extremely low, its limit value is set at 0.002% so that the sheet can be fabricated under economically satisfactory conditions.

With regard to niobium, its content by weight in the composition of the steel is less than 0.045%. Above a content of 0.045% by weight, the recrystallization of the austenite is delayed. The structure then contains a significant fraction of elongated grains, which makes it impossible to achieve the specified hole-expansion ratio Ac %. Preferably, the niobium content by weight is less than 0.04%.

The composition according to the invention also includes chromium in a quantity between 0.10% and 0.55%. A chromium content on this level makes it possible to improve the surface quality. As will be explained below, the chromium content is defined jointly with the molybdenum content.

According to the invention, silicon is present in the chemical composition of the sheet in a content by weight between 0.1 and 0.3%. Silicon retards the precipitation of cementite. In the quantities defined according to the invention, it precipitates in very small quantities, i.e. an area concentration less than 1.5% and in very fine form. This finer morphology of the cementite makes it possible to obtain a high hole-expansion capability greater than or equal to 45%. Preferably, the silicon content by weight is between 0.15 and 0.3%.

The sulfur content of the steel according to the invention must not be greater than 0.004% to limit the formation of sulfides, in particular manganese sulfides. The low levels of sulfur and nitrogen present in the composition of the steel promote its suitability for hole expansion.

The phosphorus content of the steel according to the invention is less than 0.020% to promote suitability for hole expansion and weldability.

According to the invention, the composition of the sheet includes chromium and molybdenum in specific concentrations.

Reference is made to Tables 1 to 4 as well as to FIG. 1 to explain the limits of the chromium and molybdenum contents in the composition of the sheet according to the invention.

Tables 1 to 4 show the influence of the composition of the sheet and the fabrication conditions of the sheet on the yield stress, the maximum tensile strength, the total elongation at failure, the hole expansion and an oxidation criterion measured in the middle or core of the coil and in the strip axis, whereby these concepts of coil core and strip axis are explained in greater detail below.

The hole-expansion method is described in ISO standard 16630:2009 as follows: after the creation of a hole by cutting in a sheet, a cone-shaped tool is used to expand the edges of this hole. It is during this operation that early damage in the vicinity of the edges of the hole during the expansion can be observed, whereby this damage begins on the second phase particles or at the interfaces between the different microstructural components in the steel.

The hole-expansion method therefore consists of measuring the initial diameter Di of a hole before stamping, then the final diameter Df of the hole after stamping, measured at the time cracks that run all the way through are observed in the thickness of the sheet on the edges of the hole. The hole-expansion capability Ac % is then determined according to the following formula:

$$Ac\% = 100 \times \frac{(Df - Di)}{Di}.$$

Ac therefore makes it possible the ability of a steel to withstand stamping at the level of a cut orifice. According to this method, the initial diameter is 10 millimeters.

As explained above, the objective is to prevent the formation of intergranular oxidation, which is characterized by discontinuities on the surface of the coiled and pickled sheet.

It is therefore a question of obtaining a surface for which the depth of these defects is sufficiently low so that after the forming of the sheet, the increase in the local stress intensity factor associated with these defects introduced by this forming does not threaten the fatigue life of the sheet.

The inventors have shown that two criteria relative to the presence of defects in the coiled sheet must be satisfied to obtain excellent fatigue performance. More specifically, these criteria must be respected in an area of the coil that is subjected to specific conditions. This zone is located in the core of the coil and on the strip axis where the oxygen partial pressure is lower but sufficient so that elements that are more oxidizable than iron can be oxidized. This phenomenon is observed when the sheet is coiled in adjacent turns at a minimum coiling temperature of 3 metric tons-force.

The coil core is defined as the area in the length of the coil from which an end zone is cut off on both sides, the length of each of the end zones being equal to 30% of the total length of the coil. The strip axis is defined in a similar fashion as a zone centered on the middle of the strip in the direction transverse to the rolling direction and having a width equal to 60% of the width of the strip.

Figure 2:
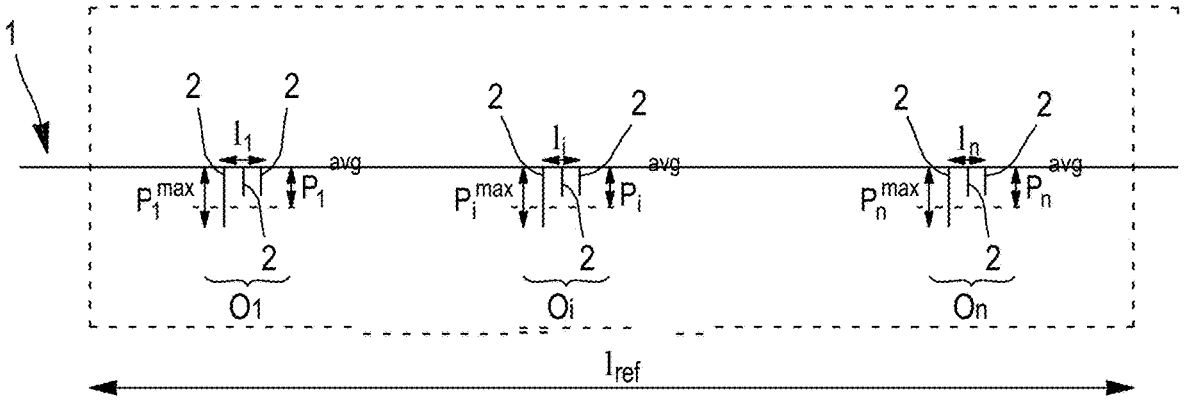
FIG. 2 is a schematic representation of the surface of a sheet seen in cross section illustrating the distribution of surface defects due to oxidation on a coiled and pickled sheet, in view of the definition of an allowable oxidation criterion.

With reference to FIG. 2, these two oxidation criteria are evaluated on a sheet 1 in the middle of the coil and on a strip axis over an observed length $l_{ref}$.

This observed length is selected so that it is a representative characterization of the surface condition. The observed length $l_{ref}$ is set at 100 micrometers, but can be as high as 500 micrometers or even higher if the objective is to strengthen the requirements in terms of oxidation criteria.

The defects due to oxidation 2 are distributed over n oxidation zones Oi of this coiled sheet 1, where i is between 1 and n. Each oxidation zone Oi extends along a length $l_i$, and is considered distinct from the neighboring zone Oi+1 if these two zones Oi, Oi+1 are separated by a zone that is free of any oxidation defect by at least 3 micrometers in length. The first criterion [1] that the defects 2 of the sheet 1 must satisfy is a maximum depth criterion that obeys $P_i^{max} \leq 8$ micrometers, where $P_i^{max}$ is the maximum depth of a defect due to oxidation 2 on each oxidation zone Oi.

The second criterion [2] that must be satisfied by the defects 2 in the sheet 1 is an average depth criterion that expresses the more or less large presence of oxidation zones on the observed length $l_{ref}$. This second criterion is defined by $$\frac{1}{l_{reff}} \sum_{i}^{n} P_i^{avg} \times l_i \leq 2.5 \text{ micrometers},$$

micrometers, where $P_i^{avg}$ is the average depth of the defects due to oxidation over an oxidation zone Oi.

In Tables 1 to 4 as well as in FIG. 1, the surface oxidation results are represented as follows:

zero or very little oxidation: criteria [1] and [2] satisfied little oxidation: criteria satisfied severe oxidation: criteria not satisfied Zero or very little oxidation makes it possible to obtain excellent fatigue strength, even on parts that are subjected to major deformation, i.e. that exhibit an equivalent rate of plastic deformation up to 39%, the equivalent plastic deformation rate being defined at any point in the deformed part on the basis of the principal deformations ε1 and ε2, by the formula:

$$\overline{\varepsilon_c} = \frac{2}{\sqrt{3}}\sqrt{(\varepsilon_1^2 + \varepsilon_1\varepsilon_2 + \varepsilon_2^2)}.$$

Table 1 presents the results obtained for compositions that are not within the framework of the sheet according to the invention.

Table 2a represents compositions of sheets according to the invention and Table 2b represents the results obtained for the compositions of sheets in Table 2a, which sheets are intended to be not coated and coiled at a constant temperature of 590° C., with the exception of example 5.

Table 3 represents the results obtained for compositions of the sheet according to the invention, which is also intended to be not coated and for coiling temperatures varying from 526° C. to 625° C.

Table 4 represents the results obtained for compositions of the sheet according to the invention which is intended to be galvanized and for a coiling temperature varying from 535° C. to 585° C.

The counterexamples 1 and 11 and Table 1 show that when the chromium and molybdenum contents do not satisfy the conditions of the invention, the oxidation criteria are not satisfied.

The counterexamples 5, 6, 7 and 9 show that in the presence of chromium but without molybdenum, the oxidation also does not satisfy the criteria. Counterexample 9 also illustrates that the addition of nickel does not obtain satisfactory results in terms of oxidation criteria.

Conversely, counterexample 4 shows that in the presence of molybdenum, but with a very low content of chromium, the surface oxidation does not satisfy the predefined criteria.

Finally, counterexamples 2, 3, 8 and 11 show that the respective contents of chromium and molybdenum must be sufficient.

Table 2b illustrates the results obtained for a composition of the sheet including chromium and molybdenum in respective levels between 0.15% and 0.55% for chromium and between 0.05% and 0.32% for molybdenum.

Table 3 illustrates the results obtained for a composition of the sheet including chromium and molybdenum in respective contents between 0.30% and 0.32% for chromium and between 0.15% and 0.17% for molybdenum.

Table 4 illustrates the results obtained for a composition of the sheet including chromium and molybdenum in respective contents between 0.31% and 0.32% for chromium and between 0.15% and 0.16% for molybdenum. Each of the examples in Tables 2, 3 and 4 satisfies the oxidation criteria defined above.

Figure 7:
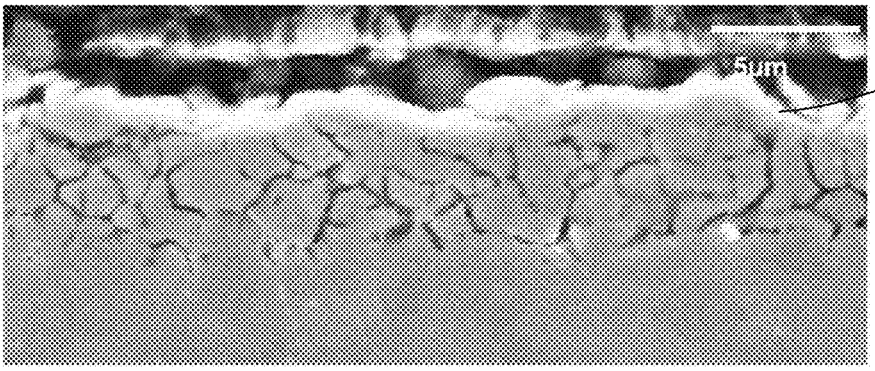
FIG. 7 is a photograph taken with a Scanning Electron Microscope representing the surface condition in section of a sheet after pickling, the composition of which is outside the scope of the invention and that does not satisfy the oxidation criteria.

FIG. 7 illustrates the presence of surface defects for a sheet 9 that does not satisfy the oxidation criteria defined above and the composition of which includes 0.3% chromium and 0.02% molybdenum.

Figure 8:
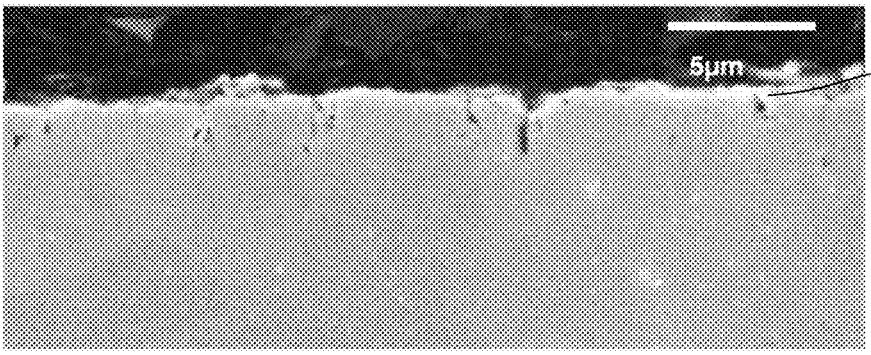
FIG. 8 is a photograph taken with a Scanning Electron Microscope representing the surface condition in section of a sheet according to the invention after pickling that satisfies the oxidation criteria.
Figure 9:
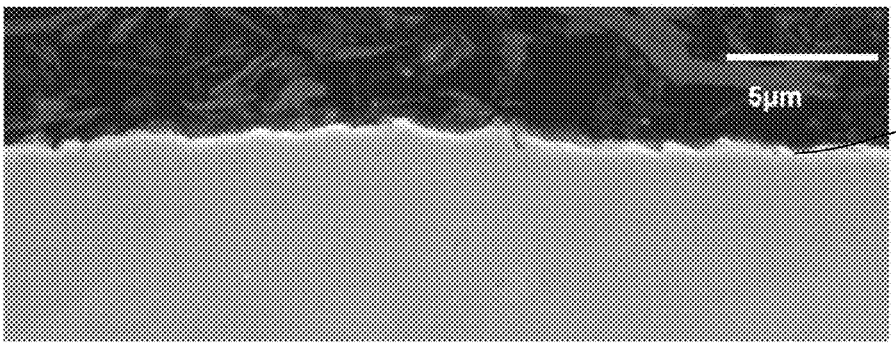
FIG. 9 is a photograph taken with a Scanning Electron Microscope representing the surface condition in section of a sheet according to the invention after pickling, the composition of which differs from that of the sheet shown in FIG. 8 and that also satisfies the oxidation criteria.

FIGS. 8 and 9 illustrate the surface condition of two sheets 10, 11 that satisfy the oxidation criteria and the respective composition of which includes 0.3% chromium and 0.093% molybdenum in FIG. 8, and 0.3% chromium and 0.15% molybdenum in FIG. 9.

It should be recalled that the sheets that are the subject of the results presented in Tables 2 to 4 are coiled in adjacent turns at a minimum coiling tension of 3 metric tons-force.

FIG. 1 shows the experimental points obtained for the counterexamples and examples at a coiling temperature of 590° C. More precisely, the experimental points 3 correspond to the counterexamples in Table 1, the experimental points 4*a* correspond to the examples in Tables 2a and 2b for which the surface oxidation is low and the experimental points 4*b* correspond to the examples in Tables 2a and 2be for which the surface oxidation is zero or very low.

It should be noted the quasi-superimposition of two experimental points at 0.10% molybdenum. A first experimental point 3 corresponds to counterexample 11, for which the precise chromium content is 0.150, and a second experimental point 4*a* corresponds to example 11 for which the precise chromium content is 0.152.

With regard to the above information, the invention therefore teaches that the composition of the sheet according to the invention includes chromium and molybdenum with a content of chromium by weight which is strictly greater than 0.15% and less than or equal to 0.6% when the molybdenum content is between 0.05% and 0.11%, and a content of chromium by weight between 0.10% and 0.6% when the molybdenum content is strictly greater than 0.11% and less than or equal to 0.35%. The molybdenum content is therefore between 0.05% and 0.35%, respecting the chromium contents expressed above.

Preferably, the content of chromium by weight is between 0.16% and 0.55% when the content by weight of molybdenum is between 0.05 and 0.11%, and the content of chromium by weight is between 0.10 and 0.55% when the content by weight of molybdenum is between 0.11% and 0.25%.

Even more preferably, the content of chromium by weight is between 0.27% and 0.52% and the content of molybdenum by weight is between 0.05% and 0.18%.

The microstructure of the sheet according to the invention includes granular bainite.

The granular bainite is distinguished from upper and lower bainite. Reference is made here to the article entitled *Characterization and Quantification of Complex Bainitic Complex Microstructures in High and Ultra-High Strength Steels—Materials Science Forum, Vol.* 500-501, pp 387-394; November 2005, for the definition of granular bainite.

In accordance with this article, the granular bainite that makes up the microstructure of the sheet according to the invention is defined as having a high proportion of severely disoriented adjacent grains and an irregular morphology of the grains. The area percentage of granular bainite is greater than 70%.

In addition, ferrite is present in an area percentage that does not exceed 20%. The possible additional amount is constituted by lower bainite, martensite and residual austenite, the sum of the contents of martensite and residual austenite being less than 5%.

Figure 10:
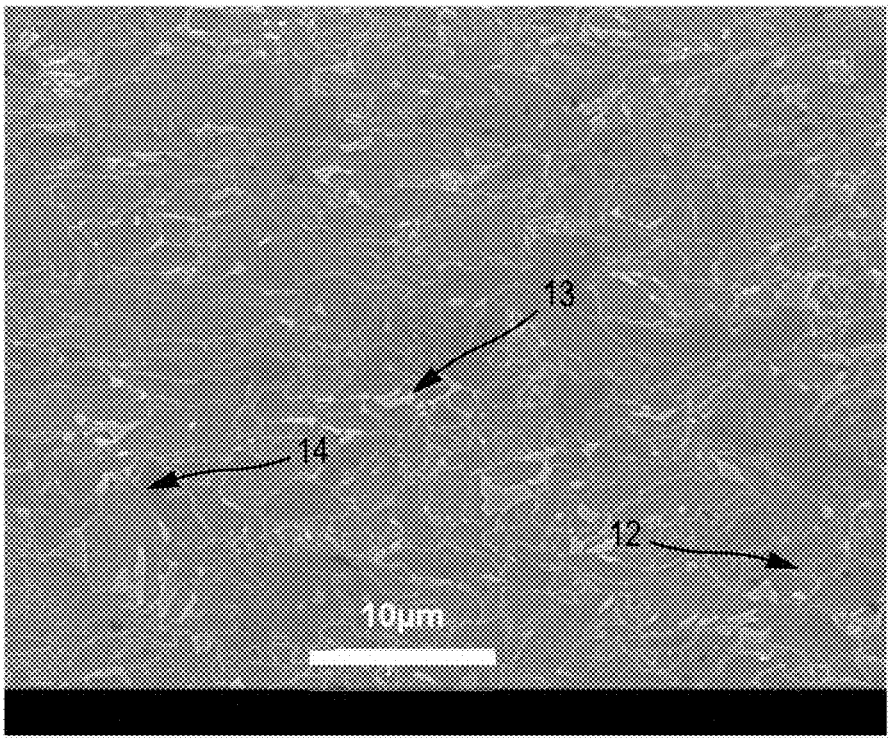
FIG. 10 is a photograph taken with a Scanning Electron Microscope representing the microstructure of a sheet according to the invention.

FIG. 10 represents the microstructure of a sheet according to the invention also including granular bainite 12, islands of martensite and austenite 13 and of ferrite 14.

It has been determined according to the invention that one criteria to be taken into consideration for the yield stress and maximum tensile strength is what is termed effective titanium.

Assuming that the precipitation of the titanium occurs in the form of nitride and taking into consideration the stoichiometric ratio of these two elements in the titanium nitride, the effective titanium $Ti_{eff}$ represents the quantity of excess titanium likely to precipitate in the form of carbides. Therefore the effective titanium is defined according to the formula $Ti_{eff}=Ti-3.42\times N$, where Ti is the titanium content expressed in weight, and N is the nitrogen content expressed by weight.

Tables 2 to 4 present the values of effective titanium for each composition tested.

Figure 3:
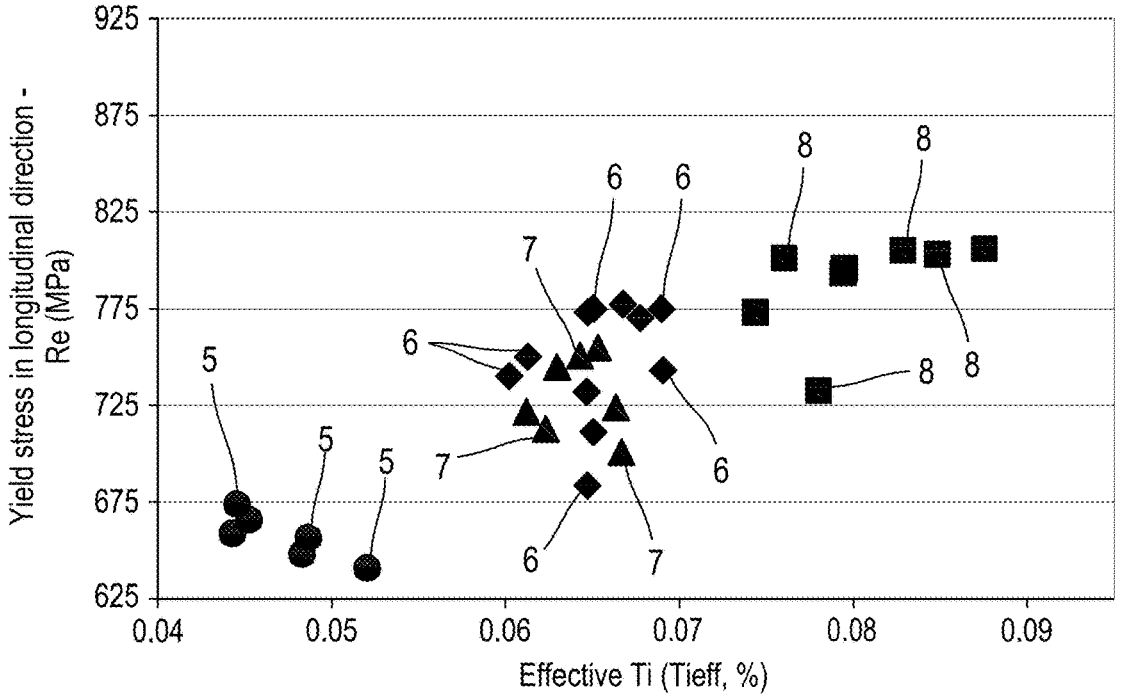
FIG. 3 is a graph illustrating the trend of the yield stress measured in the rolling direction as a function of the effective titanium content of the sheets according to the invention for which the titanium and nitrogen contents vary.
Figure 4:
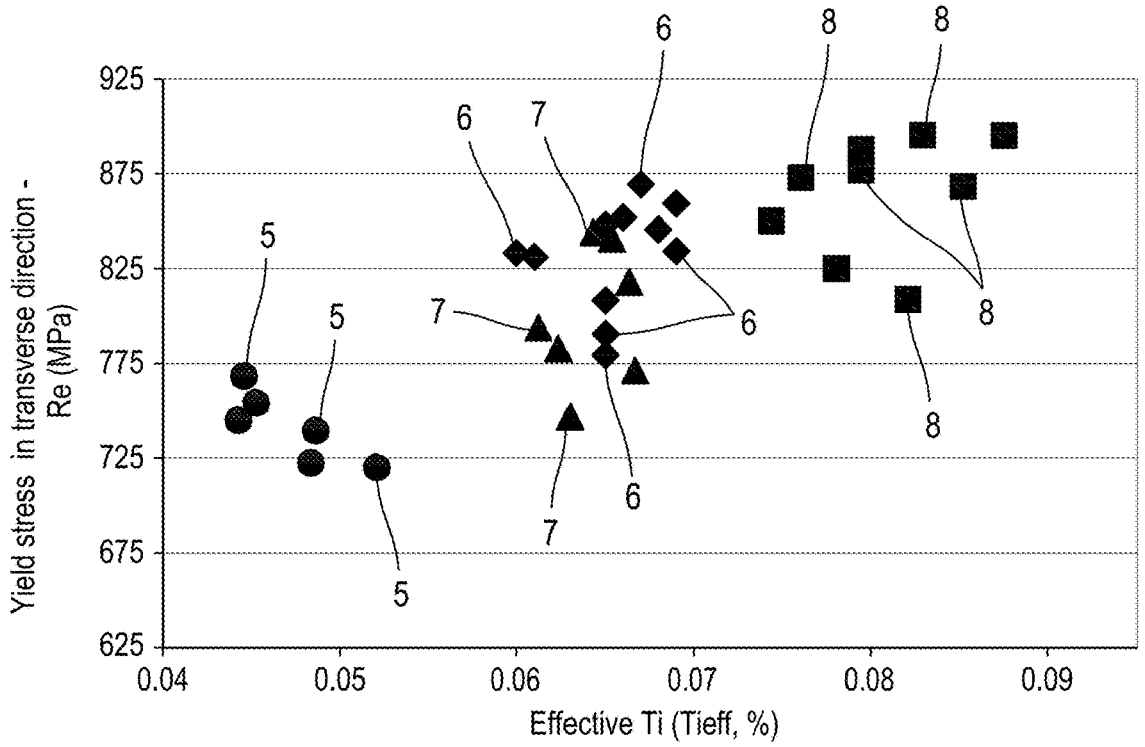
FIG. 4 is a graph illustrating the trend of the yield stress in the direction transverse to the rolling direction as a function of the effective titanium content of the sheets according to the invention for which the titanium and nitrogen levels vary.
Figure 5:
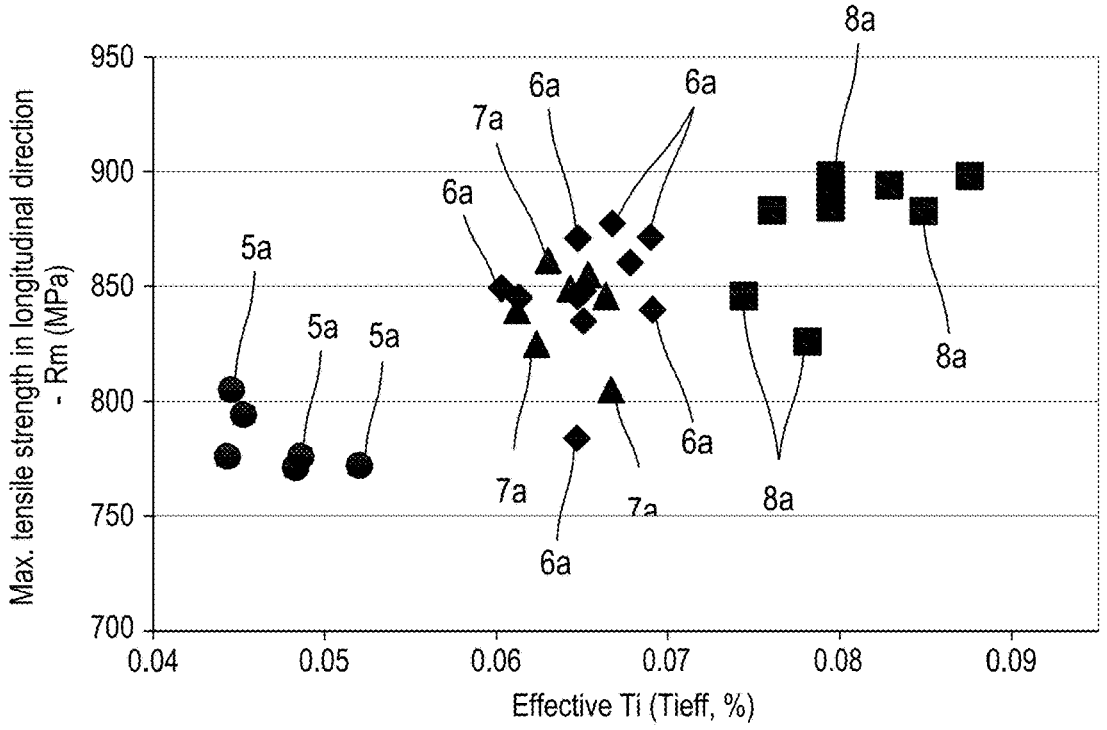
FIG. 5 is a graph illustrating the trend of the maximum tensile strength in the rolling direction as a function of the effective titanium content of the sheets according to the invention for which the titanium and nitrogen contents vary.
Figure 6:
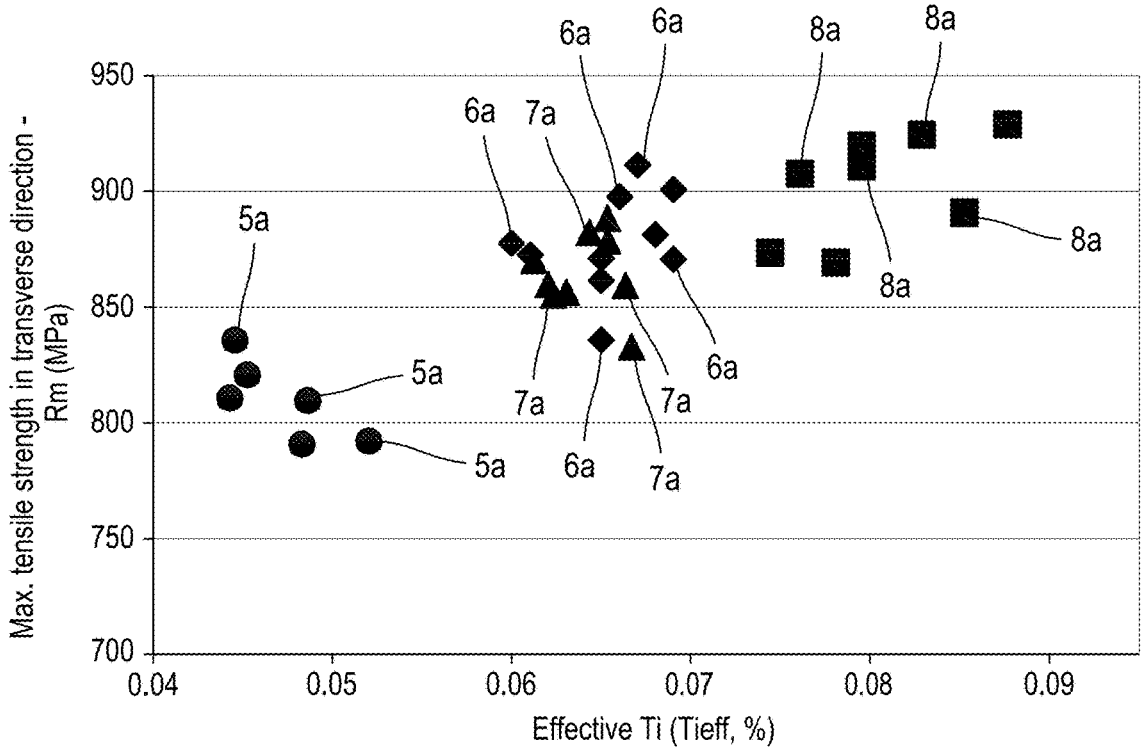
FIG. 6 is a graph illustrating the trend of maximum tensile strength in the direction transverse to the rolling direction as a function of the effective titanium content of the sheets according to the invention for which the titanium and nitrogen contents vary.

FIGS. 3 to 6 illustrate the results obtained for the elastic limit and maximum tensile strength respectively as a function of the effective titanium content for different compositions for which the pairs of titanium and nitrogen contents vary. FIGS. 3 and 5 illustrate these properties in the rolling direction of the sheet, and FIGS. 4 and 6 illustrate these properties in the direction transverse to the rolling of the sheet.

In FIGS. 3 to 6, the experimental points 5, 5*a* represented by the solid circles correspond to a composition for which the titanium content varies between 0.071% and 0.076% and the nitrogen content varies between 0.0070% and 0.0090%, the experimental points 6, 6*a* represented by the solid lozenges correspond to a composition for which the titanium content varies between 0.087% and 0.091% and the nitrogen content varies between 0.0060% and 0.0084%, the experimental points 7, 7*a* represented by the solid triangles correspond to a composition for which the titanium content varies between 0.088% and 0.092%, and the nitrogen content varies between 0.0073% and 0.0081%, and the experimental points 8, 8*a* represented by the solid squares correspond to a composition for which the titanium content varies between 0.098% and 0.104% and the nitrogen content varies between 0.0048% and 0.0070%.

With regard to these figures, it is apparent that the effective titanium must be taken into consideration.

More specifically, in the direction of rolling (FIGS. 3 and 5), the yield stress and maximum tensile strength criteria are respected for an effective titanium content that varies between 0.055% and 0.095%. In the direction transverse to the rolling direction (FIGS. 4 and 6), the yield stress and maximum tensile strength characteristics are respected for an effective titanium content that varies between 0.040% and 0.070%.

The invention therefore teaches that the composition can include an effective titanium content that varies between 0.040% and 0.095%, preferably between 0.055% and 0.070% where the criteria are respected both in the rolling direction and transverse to the rolling direction.

The advantage offered by the consideration of the effective titanium resides in particular in the ability to use a high nitrogen content to avoid limiting the nitrogen content, which is a constraining factor for the processing of the sheet.

The fabrication method for a steel sheet as defined above includes the following steps:

A steel is provided in the form of liquid metal having the composition described below, expressed in percent by weight:

$0.04\%\leq C\leq 0.08\%$
$1.2\%\leq Mn\leq 1.9\%$
$0.1\%\leq Si\leq 0.3\%$
$0.07\%\leq Ti\leq 0.125\%$
$0.05\%\leq Mo\leq 0.35\%$
$0.15\%<Cr\leq 0.6\%$ when $0.05\%\leq Mo\leq 0.11\%$, or
$0.10\%\leq Cr\leq 0.6\%$ when $0.11\%<Mo\leq 0.35\%$
$Nb\leq 0.045\%$
$0.005\%\leq Al\leq 0.1\%$
$0.002\%\leq N\leq 0.01\%$
$S\leq 0.004\%$
$P<0.020$
and optionally 0.001% V 0.2%
the remainder consisting of iron and unavoidable impurities.

To the liquid metal containing a dissolved nitrogen content [N], titanium [Ti] is added so that the quantities of titanium [Ti] and nitrogen [N] dissolved in the liquid metal satisfy % [Ti] % [N]$<6.10^{-4}\%^2$.

The liquid metal is then subjected either to a vacuum treatment or a silicon calcium (SiCa) treatment, in which case the invention teaches that the composition also contains a content by weight of $0.0005\leq Ca\leq 0.005\%$.

Under these conditions, the titanium nitrides do not precipitate prematurely in coarse form in the liquid metal, the effect of which would be to reduce the hole expandability. The precipitation of the titanium occurs at a lower temperature in the form of uniformly distributed fine carbonitrides. This fine precipitation contributes to the hardening and refining of the microstructure.

The steel is then cast to obtain a cast semi-finished product, preferably by continuous casting. Very preferably, the casting can be performed between cylinders rotating in opposite directions to obtain a cast semi-finished product in the form of thin slabs or thin strips. These casting methods result in a reduction in the size of the precipitates, which is favorable to the hole expansion in the product obtained in the final state.

The semi-finished product obtained is then reheated to a temperature between 1160 and 1300° C. Below 1160° C., the specified mechanical tensile strength of 780 MPa is not achieved. Naturally, in the case of direct casting of thin slabs, the hot rolling step of the semi-finished products beginning at more than 1160° C. can be performed immediately after casting, i.e. without cooling the semi-finished product to ambient temperature, and therefore without the need to perform a reheating step. This cast semi-finished product is then hot rolled at an end-of-rolling temperature between 880 and 930° C., the reduction rate of the penultimate pass being less than 0.25, the reduction rate of the final pass being less than 0.15, the sum of the two reduction rates being less than 0.37, and the start of rolling temperature of the penultimate pass being less than 960° C., to obtain a hot rolled product.

During the final two passes, the rolling is therefore conducted at a temperature below the non-recrystallization temperature, which prevents the recrystallization of the austenite. This requirement is specified to avoid causing excessive deformation of the austenite during these final two passes.

These conditions make it possible to create the most equiaxial grain possible to satisfy the requirements relative to the hole-expansion ratio Ac %.

After rolling, the hot rolled product is cooled at a rate between 20 and 150° C./s, preferably between 50 and 150° C./s, to obtain a hot rolled steel sheet.

Finally, the sheet obtained is coiled at a temperature between 525 and 635° C.

In the case of the fabrication of a non-coated sheet and with reference to Tables 2 and 3, the coiling temperature will be between 525 and 635° C. so that the precipitation is denser and to achieve the maximum possible hardening, which makes it possible to achieve a mechanical tensile strength greater than 780 MPa in the longitudinal direction and in the transverse direction. In accordance with the results presented in these tables, these coiling temperatures make it possible to obtain a sheet for which the oxidation criterion is satisfied.

With reference to Table 3, it will be noted that the increase of the coiling temperature (examples 26 and 28) generates defects due to oxidation that are absent at lower coiling temperatures. Nevertheless, the composition of the sheet according to the invention makes it possible to coil the sheet at high temperatures while respecting the oxidation criterion.

In the case of the fabrication of a sheet intended to be subjected to a galvanization operation and with reference to Table 4, the coiling temperature will be between 530 and 600° C., regardless of the desired direction of the properties in the direction of rolling or in the transverse direction and to compensate for the additional precipitation that occurs during the reheating treatment associated with the galvanizing operation. In accordance with the results presented in this table, these coiling temperatures make it possible to obtain a sheet for which the oxidation criterion is satisfied.

In this latter case, the coiled sheet will then be pickled according to a well-known conventional technique, then reheated to a temperature between 550 and 750° C. The sheet will then be cooled at a rate between 5 and 20° C. per second, then coated with zinc in a suitable zinc bath.

All the steel sheets according to the invention have been rolled with a reduction rate less than 0.15 in the penultimate rolling pass, and a reduction rate less than 0.07 in the final rolling pass, whereby the cumulative deformation during these two passes is less than 0.37. At the conclusion of hot rolling, a less-deformed austenite is therefore obtained.

Therefore the invention makes it possible to make available steel sheets that have high mechanical tensile characteristics and a good suitability for forming by stamping. The stamped parts fabricated from these sheets have a high fatigue strength on account of the minimization or absence of surface defects after stamping.

TABLE 1

Test conditions and results obtained for conditions that do not correspond to the invention

| | Chemical composition (in %) | | | | | | | | | | | | |
|---|---|---|---|---|---|---|---|---|---|---|---|---|---|
| | C | Mn | Si | Al | Cr | Mo | Nb | Ti | Ni | P | S | N | Tieff |
| Counter-example 1 | 0.049 | 1.64 | 0.21 | 0.03 | 0 | 0 | 0.041 | 0.112 | — | — | 0.003 | 0.004 | 0.097 |
| Counter-example 2 | 0.062 | 1.59 | 0.24 | 0.08 | 0.29 | 0.005 | 0.031 | 0.109 | — | 0.015 | 0.002 | 0.007 | 0.085 |
| Counter-example 3 | 0.060 | 1.58 | 0.23 | 0.04 | 0.29 | 0.026 | 0.031 | 0.114 | — | 0.015 | 0.001 | 0.006 | 0.093 |
| Counter-example 4 | 0.069 | 1.86 | 0.24 | 0.03 | 0.003 | 0.15 | 0.024 | 0.102 | — | 0.020 | 0.001 | 0.005 | 0.085 |
| Counter-example 5 | 0.053 | 1.30 | 0.21 | 0.04 | 0.15 | 0 | 0.030 | 0.105 | — | 0.014 | 0.002 | 0.006 | 0.084 |
| Counter-example 6 | 0.054 | 1.63 | 0.21 | 0.04 | 0.30 | 0 | 0.031 | 0.105 | — | 0.014 | 0.002 | 0.006 | 0.084 |
| Counter-example 7 | 0.055 | 1.65 | 0.24 | 0.04 | 0.61 | 0 | 0.031 | 0.080 | — | 0.017 | 0.001 | 0.006 | 0.059 |
| Counter-example 8 | 0.067 | 1.59 | 0.24 | 0.04 | 0.15[1] | 0.10 | 0.028 | 0.115 | — | 0.009 | 0.001 | 0.006 | 0.094 |
| Counter-example 9 | 0.065 | 1.61 | 0.24 | 0.04 | 0.33 | 0 | 0.031 | 0.123 | 0.230 | 0.013 | — | 0.008 | 0.095 |
| Counter-example 10 | 0.053 | 1.78 | 0.22 | 0.02 | 0 | 0 | 0.030 | 0.105 | — | 0.012 | 0.001 | 0.006 | 0.084 |
| Counter-example 11 | 0.050 | 1.46 | 0.24 | 0.04 | 0.15[2] | 0.05 | 0.030 | 0.089 | — | 0.012 | 0.002 | 0.008 | NA |

| | Coiling temperature (° C.) | Yield stress Re (Mpa) | Maximum tensile strength Rm (Mpa) | Total elongation at failure (%) | Hole-expansion Ac (ISO Method) (%) | Oxidation criteria in coil core | Oxidation criteria legend |
|---|---|---|---|---|---|---|---|
| Counter-example 1 | 590 | 816.5 | 821 | 14.8 | 66.47 | ● | ○ zero or very little oxidation: criterion satisfied |
| Counter-example 2 | 590 | 785 | 814 | 17.2 | NA | ● | ⭘ little oxidation: criterion satisfied |
| Counter-example 3 | 590 | 810 | 835 | 16.8 | NA | ● | ● severe oxidation: criterion not satisfied |
| Counter-example 4 | 590 | NA | NA | NA | NA | ● | |
| Counter-example 5 | 590 | 747 | 778 | 17.4 | 53 | ● | |
| Counter-example 6 | 590 | 768 | 797 | 17.5 | 49 | ● | |
| Counter-example 7 | 590 | NA | NA | NA | NA | ● | |
| Counter-example 8 | 590 | 854 | 877 | 14.3 | NA | ● | |
| Counter-example 9 | 590 | 829 | 849 | 15.9 | NA | ● | |

TABLE 1-continued

| Test conditions and results obtained for conditions that do not correspond to the invention | | | | | | |
|---|---|---|---|---|---|---|
| Counter-example 10 | 590 | 764 | 786 | 15.5 | 72 | ● |
| Counter-example 11 | 590 | 703 | 748 | 16.5 | NA | ● |

NA: not determined -
[1]Exact value: 0.150 -
[2]Exact value: 0.150

TABLE 2a

| Compositions of sheets according to the invention | | | | | | | | | | | | |
|---|---|---|---|---|---|---|---|---|---|---|---|---|
| | Chemical composition (in %) | | | | | | | | | | | |
| | C | Mn | Si | Al | Cr | Mo | Nb | Ti | P | S | N | Tieff |
| Example 1 | 0.06 | 1.6 | 0.2 | 0.06 | 0.29 | 0.09 | 0.031 | 0.110 | 0.015 | 0.002 | 0.007 | 0.086 |
| Example 2 | 0.06 | 1.6 | 0.2 | 0.04 | 0.29 | 0.05 | 0.034 | 0.115 | 0.015 | 0.001 | 0.006 | 0.094 |
| Example 3 | 0.06 | 1.6 | 0.2 | 0.04 | 0.29 | 0.11 | 0.034 | 0.111 | 0.015 | 0.001 | 0.006 | 0.090 |
| Example 4 | 0.06 | 1.5 | 0.2 | 0.06 | 0.38 | 0.15 | 0.026 | 0.100 | 0.017 | 0.001 | 0.006 | 0.078 |
| Example 5 | 0.07 | 1.5 | 0.2 | 0.04 | 0.30 | 0.16 | 0.030 | 0.100 | 0.016 | 0.001 | 0.005 | 0.083 |
| Example 6 | 0.06 | 1.5 | 0.3 | 0.03 | 0.41 | 0.11 | 0.033 | 0.093 | 0.017 | 0.002 | 0.009 | 0.063 |
| Example 7 | 0.06 | 1.5 | 0.3 | 0.03 | 0.51 | 0.11 | 0.033 | 0.094 | 0.017 | 0.002 | 0.01 | 0.059 |
| Example 8 | 0.06 | 1.5 | 0.2 | 0.05 | 0.28 | 0.15 | 0 | 0.098 | 0.017 | 0.001 | 0.003 | 0.087 |
| Example 9 | 0.080 | 1.61 | 0.23 | 0.04 | 0.15 | 0.15 | 0.028 | 0.113 | 0.012 | 0.001 | 0.006 | 0.092 |
| Example 10 | 0.06 | 1.5 | 0.21 | 0.05 | 0.47 | 0.15 | 0.030 | 0.074 | 0.015 | 0.002 | 0.008 | 0.047 |
| Example 11 | 0.05 | 1.5 | 0.24 | 0.04 | 0.15[1] | 0.10 | 0.030 | 0.089 | 0.012 | 0.002 | 0.007 | 0.065 |
| Example 12 | 0.05 | 1.5 | 0.24 | 0.04 | 0.15 | 0.25 | 0.030 | 0.094 | 0.013 | 0.002 | 0.008 | 0.066 |
| Example 13 | 0.05 | 1.5 | 0.24 | 0.04 | 0.30 | 0.25 | 0.030 | 0.092 | 0.012 | 0.002 | 0.008 | 0.064 |
| Example 14 | 0.05 | 1.5 | 0.25 | 0.04 | 0.21 | 0.06 | 0.033 | 0.087 | 0.012 | 0.001 | — | 0.063 |
| Example 15[2] | 0.05 | 1.5 | 0.25 | 0.04 | 0.21 | 0.09 | 0.033 | 0.087 | 0.012 | 0.001 | — | 0.063 |
| Example 16 | 0.05 | 1.5 | 0.25 | 0.04 | 0.21 | 0.15 | 0.032 | 0.088 | 0.012 | 0.001 | — | 0.064 |
| Example 17 | 0.05 | 1.5 | 0.25 | 0.04 | 0.21 | 0.32 | 0.033 | 0.089 | 0.013 | 0.001 | — | 0.065 |
| Example 18[2] | 0.05 | 1.5 | 0.25 | 0.04 | 0.25 | 0.15 | 0.032 | 0.088 | 0.012 | 0.002 | 0.008 | 0.060 |
| Example 19 | 0.05 | 1.4 | 0.25 | 0.03 | 0.30 | 0.20 | 0.032 | 0.089 | 0.013 | 0.002 | 0.008 | 0.061 |
| Example 20 | 0.05 | 1.5 | 0.25 | 0.04 | 0.55 | 0.05 | 0.030 | 0.089 | 0.012 | 0.002 | 0.009 | 0.058 |
| Example 21 | 0.05 | 1.5 | 0.25 | 0.04 | 0.54 | 0.11 | 0.030 | 0.087 | 0.012 | 0.002 | 0.008 | 0.059 |
| Example 22 | 0.05 | 1.4 | 0.24 | 0.03 | 0.16 | 0.20 | 0.030 | 0.088 | 0.013 | 0.002 | 0.008 | 0.060 |
| Example 23 | 0.05 | 1.4 | 0.24 | 0.03 | 0.19 | 0.20 | 0.030 | 0.088 | 0.013 | 0.002 | 0.008 | 0.060 |
| Example 24 | 0.05 | 1.4 | 0.24 | 0.04 | 0.39 | 0.24 | 0.030 | 0.087 | 0.012 | 0.002 | 0.008 | 0.059 |
| Example 25 | 0.05 | 1.5 | 0.24 | 0.04 | 0.53 | 0.26 | 0.030 | 0.088 | 0.012 | 0.002 | 0.008 | 0.060 |

[1]Exact value: 0.152 -
[2]Also contains vanadium V = 0.005%

TABLE 2b

| Test conditions and results obtained for compositions of sheets according to the invention from Table 2a coiled at 590° C. and not coated | | | | | | | |
|---|---|---|---|---|---|---|---|
| | Coiling temperature (° C.) | Yield stress Re (Mpa) | Maximum tensile strength Rm (Mpa) | Total elongation at failure (%) | Hole-expansion Ac (ISO method) (%) | Oxidation criterion in core of coil | Oxidation criterion legend |
| Example 1 | 590 | 808 | 841 | 15.8 | NA | ⊙ | ○ zero or very little oxidation: criterion satisfied |
| Example 2 | 590 | 820 | 848 | 15.9 | NA | ⊙ | ⊙ little oxidation: criterion satisfied |
| Example 3 | 590 | 823 | 854 | 15 | NA | ○ | ● severe oxidation: criterion not satisfied |
| Example 4 | 590 | 792 | 832 | 16.5 | 58 | ⊙ | |
| Example 5 | 595 | 810 | 893 | 13.3 | 59 | ○ | |
| Example 6 | 590 | 766 | 801 | 15.6 | NA | ⊙ | |
| Example 7 | 590 | 761 | 798 | 17.8 | NA | ⊙ | |
| Example 8 | 590 | 787 | 818 | 15.2 | 71 | ○ | |
| Example 9 | 590 | 823* | 854 | 15.9 | NA | ⊙ | |
| Example 10 | 590 | 796 | 834 | 15.2 | 56 | ⊙ | |
| Example 11 | 590 | 711 | 801* | 17.1 | NA | ⊙ | |
| Example 12 | 590 | 768 | 809 | 16.9 | NA | ○ | |

TABLE 2b-continued

Test conditions and results obtained for compositions of sheets according to the invention from Table 2a coiled at 590° C. and not coated

| | Coiling temperature (° C.) | Yield stress Re (Mpa) | Maximum tensile strength Rm (Mpa) | Total elongation at failure (%) | Hole-expansion Ac (ISO method) (%) | Oxidation criterion in core of coil | Oxidation criterion legend |
|---|---|---|---|---|---|---|---|
| Example 13 | 590 | 781 | 825 | 16.2 | NA | ○ | |
| Example 14 | 590 | 721 | 807* | 17.8 | NA | ⭘ | |
| Example 15 | 590 | 746 | 781 | 17.0 | NA | ⭘ | |
| Example 16 | 590 | 754 | 787 | 16.0 | NA | ○ | |
| Example 17 | 590 | 751 | 788 | 16.9 | NA | ⭘ | |
| Example 18 | 590 | 759 | 793 | 19.0 | NA | ○ | |
| Example 19 | 590 | 770 | 805 | 17.7 | NA | ○ | |
| Example 20 | 590 | 721 | 814* | 16.9 | NA | ○ | |
| Example 21 | 590 | 744 | 789 | 17.6 | NA | ○ | |
| Example 22 | 590 | 757 | 799 | 16.5 | NA | ○ | |
| Example 23 | 590 | 764 | 802 | 17.5 | NA | ○ | |
| Example 24 | 590 | 796 | 837 | 16.5 | NA | ○ | |
| Example 25 | 590 | 760 | 822 | 15.8 | NA | ○ | |

*estimated value
NA: not determined

TABLE 3

Test conditions and results obtained for compositions of sheets according to the invention not coated, coiled at a temperature varying between 526 and 625° C.

| | Chemical composition (in %) | | | | | | | | | | | |
|---|---|---|---|---|---|---|---|---|---|---|---|---|
| | C | Mn | Si | Al | Cr | Mo | Nb | Ti | P | S | N | Tieff |
| Example 26 | 0.059 | 1.54 | 0.23 | 0.04 | 0.31 | 0.16 | 0.030 | 0.093 | 0.013 | 0.001 | 0.007 | 0.067 |
| Example 27 | 0.060 | 1.53 | 0.23 | 0.04 | 0.31 | 0.15 | 0.030 | 0.088 | 0.012 | 0.001 | 0.007 | 0.063 |
| Example 28 | 0.065 | 1.48 | 0.20 | 0.04 | 0.31 | 0.17 | 0.029 | 0.101 | 0.016 | 0.001 | 0.007 | 0.078 |
| Example 29 | 0.065 | 1.50 | 0.21 | 0.04 | 0.30 | 0.16 | 0.029 | 0.102 | 0.016 | 0.001 | 0.005 | 0.085 |
| Example 30 | 0.064 | 1.49 | 0.20 | 0.04 | 0.30 | 0.16 | 0.030 | 0.104 | 0.016 | 0.001 | 0.005 | 0.087 |
| Example 31 | 0.057 | 1.52 | 0.25 | 0.04 | 0.32 | 0.15 | 0.032 | 0.087 | 0.018 | 0.001 | 0.009 | 0.057 |
| Example 32 | 0.062 | 1.46 | 0.22 | 0.06 | 0.32 | 0.16 | 0.030 | 0.074 | 0.015 | 0.002 | 0.008 | 0.047 |

| | Coiling temperature | Yield stress Re (Mpa) | Maximum tensile strength Rm (Mpa) | Total elongation at failure (%) | Hole-expansion Ac (ISO Method) (%) | Oxidation criteria in core of coil | Oxidation criterion legend |
|---|---|---|---|---|---|---|---|
| Example 26 | 615 | 737 | 836 | 22.7 | 72 | ⭘ | ○ zero or very little oxidation: criterion satisfied |
| Example 27 | 585 | 695 | 829 | 15.2 | 72 | ○ | ⭘ little oxidation: criterion satisfied |
| Example 28 | 625 | 772 | 852 | 18.8 | 55 | ⭘ | |
| Example 29 | 595 | 802 | 876 | 17.7 | 53 | ○ | |
| Example 30 | 565 | 752 | 857 | 17.4 | 53 | ○ | |
| Example 31 | 535 | 732 | 846 | 15.5 | NA | ○ | |
| Example 32 | 526 | 720* | 792* | 17.3* | 71.3 | ○ | |

*measurements taken across the rolling direction
NA: not determined

TABLE 4

Test conditions and results obtained for sheets according to the invention coiled at a temperature varying between 535 and 585° C. and intended to be galvanized

| | Chemical composition (in %) | | | | | | | | | | | |
|---|---|---|---|---|---|---|---|---|---|---|---|---|
| | C | Mn | Si | Al | Cr | Mo | Nb | Ti | P | S | N | Tieff |
| Example 33 | 0.06 | 1.54 | 0.23 | 0.04 | 0.32 | 0.16 | 0.029 | 0.093 | 0.011 | 0.001 | 0.007 | 0.067 |
| Example 34 | 0.06 | 1.54 | 0.23 | 0.04 | 0.31 | 0.16 | 0.029 | 0.093 | 0.011 | 0.001 | 0.007 | 0.070 |
| Example 35 | 0.06 | 1.53 | 0.23 | 0.04 | 0.31 | 0.16 | 0.029 | 0.093 | 0.012 | 0.001 | 0.007 | 0.069 |
| Example 36 | 0.06 | 1.54 | 0.23 | 0.03 | 0.31 | 0.15 | 0.030 | 0.091 | 0.012 | 0.001 | 0.007 | 0.065 |

TABLE 4-continued

Test conditions and results obtained for sheets according to the invention coiled at a temperature varying between 535 and 585° C. and intended to be galvanized

| | Coiling temperature (° C.) | Yield stress Re (Mpa) | Maximum tensile strength Rm (Mpa) | Total elongation at failure (%) | Hole-expansion Ac ISO Method) (%) | Oxidation criterion in coil core | Oxidation criteria legend |
|---|---|---|---|---|---|---|---|
| Example 33 | 565 | 805 | 839 | 14.9 | 63 | ○ | ○ zero or very low oxidation: criterion satisfied |
| Example 34 | 535 | 811 | 850 | 13.5 | 48 | ○ | ◘ little oxidation: criterion satisfied |
| Example 35 | 540 | 790 | 826 | 13.6 | 50 | ○ | ● severe oxidation: criterion not satisfied |
| Example 36 | 585 | 807 | 862 | 15.8 | NA | ○ | |

NA: not determined

What is claimed is:

1. A method for the fabrication of a hot rolled steel comprising the steps of:

providing a liquid metal comprising the following chemical composition with contents expressed by weight:

0.04%≤C≤0.08%;

1.2%≤Mn≤1.9%;

0.1%≤Si≤0.3%;

0.07%≤Ti≤0.125%;

0.05%≤Mo≤0.35%;

0.15%<Cr≤0.6% when 0.05%≤Mo≤0.11%; or 0.10%≤Cr≤0.6% when 0.11%<Mo≤0.35%;

Nb≤0.045%;

0.005%≤Al≤0.1%;

0.002%≤N≤0.01%;

S≤0.004%; and

P<0.020%;

a remainder including iron and unavoidable impurities, carrying out a vacuum or SiCa treatment, the chemical composition including, expressed by weight 0.0005%≤Ca≤0.005%, if a SiCa treatment is carried out;

dissolving quantities of Ti and N in the liquid metal so as to satisfy (% [Ti])×(% [N])<$6.10^{-4}$%$^2$;

casting the steel to obtain a cast semi-finished product;

rolling the cast semi-finished product with an end-of-rolling temperature between 880° C. and 930° C., a reduction rate of the penultimate pass being less than 0.25, a reduction rate of the final pass being less than 0.15, a sum of these two rates of reduction being less than 0.37 and a start-of-rolling temperature of the penultimate pass being less than 960° C. to obtain a hot-rolled product, then cooling the hot rolled product at a rate between 20 and 150° C./s to obtain a hot rolled steel sheet;

coiling the hot rolled product to obtain a hot rolled steel sheet;

the hot rolled steel sheet having a thickness between 1.5 and 4.5 millimeters, a yield stress at least greater than 680 MPa in the direction transverse to the rolling direction and less than or equal to 840 MPa, a strength between 780 MPa and 950 MPa and an elongation at failure greater than 10%.

2. The method according to claim 1, wherein the chemical composition further includes 0.001%≤V≤0.2%.

3. The method according to claim 1, further comprising the step of reheating the semi-finished product to a temperature between 1160° C. and 1300° C. after the step of casting.

4. The method according to claim 1, wherein the hot rolled steel sheet is coiled at a temperature between 525 and 635° C.

5. The method according to claim 1, wherein the chemical composition consists of, expressed by weight:

0.04%≤C≤0.08%;

1.2%≤Mn≤1.9%;

0.1%≤Si≤0.3%;

0.07%≤Ti≤0.125%;

0.05%≤Mo≤0.25%;

0.16%≤Cr≤0.55% when 0.05%≤Mo≤0.11%; or 0.10%≤Cr≤0.55% when 0.11%<Mo≤0.25%;

Nb≤0.045%;

0.005%≤Al≤0.1%;

0.002%≤N≤0.01%;

S≤0.004%; and

P<0.020%;

the remainder consisting of iron and unavoidable impurities.

6. The method according to claim 1, wherein the cooling rate of the hot rolled product is between 50 and 150° C./s.

7. The method according to claim 1, wherein the chemical composition includes, expressed by weight:

0.27%≤Cr≤0.52% when 0.05%≤Mo≤0.11%, or 0.10%≤Cr≤0.52% when 0.11%<Mo≤0.25%.

8. The method according to claim 1, wherein the chemical composition includes, expressed by weight:

0.05%≤Mo≤0.18%, and in that:

0.16%≤Cr≤0.55% when 0.05%≤Mo≤0.11%, or 0.10%≤Cr≤0.55% when 0.11%<Mo≤0.18%.

9. The method according to claim 1, wherein the chemical composition includes, expressed by weight:

0.05%≤C≤0.08%;

1.4%≤Mn≤1.6%;

0.15%≤Si≤0.3%;

Nb≤0.04%; or 0.01%≤Al≤0.07%.

10. The method according to claim 1, wherein the sheet is coiled at a temperature between 580 and 630° C.

11. The method according to claim 1, wherein the sheet is coiled at a temperature between 530 and 600° C., and further comprising the steps of:

pickling the sheet, then reheating the pickled sheet to a temperature between 600 and 750° C., then cooling the reheated, pickled sheet at a rate between 5 and 20° C./s, and coating the sheet with zinc in a zinc bath.

12. The method for the fabrication of a hot rolled steel sheet according to claim 1, wherein the sheet is coiled in adjacent turns at a minimum coiling tension of 3 metric tons-force.

* * * * *